US008339338B2

(12) United States Patent
Nakamura

(10) Patent No.: US 8,339,338 B2
(45) Date of Patent: Dec. 25, 2012

(54) DISPLAY DEVICE AND DRIVING METHOD THEREOF

(75) Inventor: Mika Nakamura, Osaka (JP)

(73) Assignee: Panasonic Corporation, Osaka (JP)

( * ) Notice: Subject to any disclaimer, the term of this patent is extended or adjusted under 35 U.S.C. 154(b) by 64 days.

(21) Appl. No.: 13/155,746

(22) Filed: Jun. 8, 2011

(65) Prior Publication Data

US 2011/0234911 A1 Sep. 29, 2011

Related U.S. Application Data

(63) Continuation of application No. PCT/JP2010/000440, filed on Jan. 26, 2010.

(51) Int. Cl.
*G09G 3/30* (2006.01)

(52) U.S. Cl. ..... 345/76

(58) Field of Classification Search ..... 345/76–83; 313/463, 504; 315/169.3
See application file for complete search history.

(56) References Cited

U.S. PATENT DOCUMENTS

| | | | | |
|---|---|---|---|---|
| 6,583,775 | B1 | 6/2003 | Sekiya et al. | |
| 2006/0001628 | A1 | 1/2006 | Kawaguchi | |
| 2006/0017394 | A1 | 1/2006 | Tada et al. | |
| 2007/0132674 | A1* | 6/2007 | Tsuge | 345/77 |
| 2007/0222718 | A1* | 9/2007 | Takahara | 345/76 |
| 2008/0238854 | A1 | 10/2008 | Kimura | |
| 2008/0238897 | A1* | 10/2008 | Kimura | 345/204 |
| 2009/0109247 | A1* | 4/2009 | Kimura | 345/690 |
| 2011/0090320 | A1 | 4/2011 | Tsuchida | |

FOREIGN PATENT DOCUMENTS

| | | |
|---|---|---|
| JP | 2001-060076 | 3/2001 |
| JP | 2006-018138 | 1/2006 |
| JP | 2006-038968 | 2/2006 |
| JP | 2008-268886 | 11/2008 |

OTHER PUBLICATIONS

International Search Report in PCT/JP2010/000440, dated May 11, 2010.

* cited by examiner

*Primary Examiner* — Jimmy H Nguyen
(74) *Attorney, Agent, or Firm* — Greenblum & Bernstein, P.L.C.

(57) ABSTRACT

A display device includes a display that includes display elements arranged in lines of a matrix. Each display element is configured to emit light based on a video signal that is received by the display. A proportion determiner is configured to determine, for each line, a proportion of a single frame period during which each display element of a corresponding line is not to emit the light. A signal converter is configured to convert an amplitude of the video signal for each line according to the proportion determined for each line. A signal output is configured to output the video signal converted by the signal converter to the display as a converted video signal. A scanner is configured to output a scanning signal to the display for each line for inputting the converted video signal to the display elements of each line based on the proportion determined for each line.

14 Claims, 9 Drawing Sheets

DISPLAY DEVICE AND DRIVING METHOD THEREOF

CROSS REFERENCE TO RELATED APPLICATION

This is a continuation application of PCT Application No. PCT/JP2010/000440 filed on Jan. 26, 2010, designating the United States of America, the disclosure of which, including the specification, drawings and claims, is incorporated herein by reference in its entirety.

BACKGROUND OF THE INVENTION

1. Field of the Invention

The present invention relates to a display device and a driving method thereof, and in particular, to a hold-type display device and a driving method thereof.

2. Description of the Related Art

In a hold-type display device such as a liquid crystal display or an organic electro-luminescent (EL) display, unlike an impulse-type display device such as a cathode ray tube (CRT) display, an image is continuously held during a frame period, which makes a moving image unclear. More specifically, in the case of the hold-type display device, an image is held and displayed as a still image in a frame period, and the moving image is displayed by switching the screen for every frame. Therefore, the still image is seamlessly switched in a transition period from one frame to another. This causes the user to recognize the frame image of one before as an after image, to sense a double image where the images of both frames are overlapped, and to recognize a moving image blur.

As a method for resolving the moving image blur, there is a proposed technique for reducing the moving image blur caused due to overlapping recognition of the current frame image and the afterimage of the frame one before by inserting a black image in a single frame period at a predetermined rate, and the technique is practically used.

Here, references are made to the technique for inserting a black image in a single frame period at a predetermined rate.

FIG. 9 is a graph showing a black insertion technique. The horizontal axis represents video signal data. The vertical axis represents luminance level in a single frame. The video signal data represented by the horizontal axis is, for example, a digital value that is an input gray level ranging from 0 to 255. In FIG. 9, in the case where the black insertion rate is 0%, in other words, in the case where black insertion is not performed in a single frame period, 0 to 255 that is the input gray level of the video signal data correspond to the luminance level of 0 to 100% in a single frame. On the other hand, for example, in the case where a black image is inserted in 40% of a single frame period, in other words, in the case where the black insertion rate is 40%, 0 to 255 that is the input gray level of the video signal data correspond to the luminance level of 0 to 60% in a single frame. Further, for example, in the case where a black image is inserted in 80% of a single frame period, in other words, in the case where the black insertion rate is 80%, 0 to 255 that is the input gray level of the video signal data correspond to the luminance level of 0 to 20% in a single frame. More specifically, when a user recognizes the luminance of a single frame, not only the input gray level of 0 to 255 is changed for light-emitting display, but also the black insertion rate is changed even in the same input gray level. This enables variation of the luminance level to be recognized. For example, the luminance level of a single frame that is recognized by the user is the same between the case where light is emitted in 50% of a single frame period at the input gray level of 255 and the black image is inserted in the remaining 50% at the gray level of 0, and the case where light is emitted in the entire single frame period at the input gray level of 127. However, the former case where the black image is inserted between frames can reduce the moving image blur.

Japanese Patent Application Publication No. 2006-018138 discloses a black insertion technique where, in an optically compensated birefringence (OCB) type liquid crystal display device, a high voltage is periodically applied not only during a blanking period, but also during a video signal writing period to prevent occurrence of the inverse transfer that is caused if the driving voltage is maintained at low voltage level. According to the disclosure, it is possible to set a high voltage period for preventing occurrence of the inverse transfer over a long period.

Japanese Patent Application Publication No. 2008-268886 discloses a technique where a black image is inserted at a predetermined rate in a single frame period to enhance the image quality of the moving image and where the black insertion rate with respect to one frame period is set variably according to each usage state.

SUMMARY OF THE INVENTION

However, the black insertion techniques disclosed in Patent Literatures 1 and 2 determine the black insertion rate on a frame-by-frame basis. In other words, the image writing time and the black insertion timing are driven in row-sequential order.

Further, the black insertion rate is fixed on a frame by frame basis; and thus, for example, the black insertion rate is determined depending on the maximum luminance level within a same frame. With this, in the case of an image having a large luminance difference within the same frame, the moving image blur is reduced and the image quality is enhanced relative to the portion having a high luminance level. However, the black insertion rate is hardly increased relative to the portion having a low luminance level, which does not greatly contribute to enhancing the image quality such as increasing the gray level.

In view of the problems, the present invention has an object to provide a display device which is capable of reducing the moving image blur even in an image having various gray levels, and is also capable of achieving a uniformly high-quality image, and a driving method thereof.

In order to achieve the object, the display device according to an implementation of the present invention includes: a display unit including a plurality of display elements arranged in a matrix, the display elements emitting light based on a video signal that is input; a proportion determination unit which determines, for each of lines of the matrix, a proportion of a period to a single frame period, the period being a period during which each of the display elements is caused not to emit light that is based on the video signal; a signal conversion unit which converts, for each of the lines, an amplitude of the video signal according to the proportion determined by the proportion determination unit; a signal output unit which outputs the video signal converted by the signal conversion unit, to the display unit; and a scanning unit which outputs a scanning signal to the display unit for each of the lines such that the converted video signal is input to each of the display elements based on the determined proportion.

According to the display device and the driving method thereof according to an implementation of the present invention, the black insertion rate can be increased relative to a portion which has a low luminance level, by finely setting the black insertion rate on a line-by-line basis. Accordingly, it is possible to resolve the moving image blur, and also to increase range of gray levels in a portion with dark gray levels.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT(S)

Figure 1:
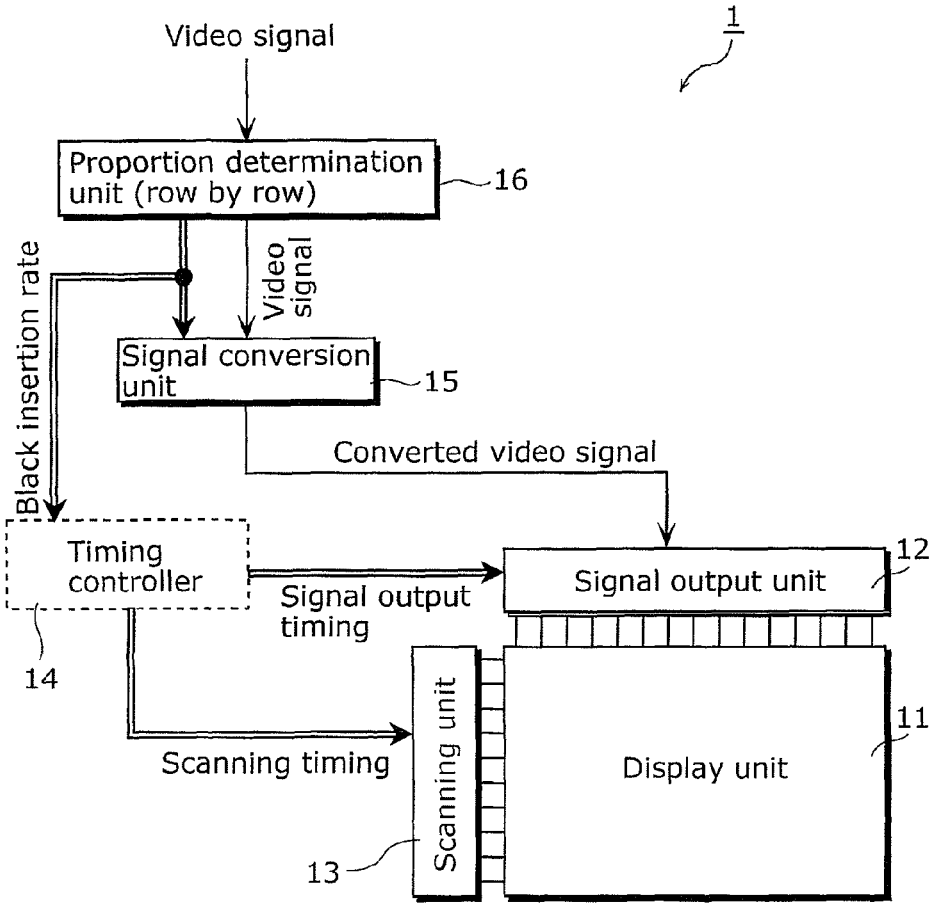
FIG. 1 is a functional block diagram of a display device according to Embodiments of the present invention.

The display device according to an implementation of the present invention includes: a display unit including a plurality of display elements arranged in a matrix, the display elements emitting light based on a video signal that is input; a proportion determination unit which determines, for each of lines of the matrix, a proportion of a period to a single frame period, the period being a period during which each of the display elements is caused not to emit light that is based on the video signal; a signal conversion unit which converts, for each of the lines, an amplitude of the video signal according to the proportion determined by the proportion determination unit; a signal output unit which outputs the video signal converted by the signal conversion unit, to the display unit; and a scanning unit which outputs a scanning signal to the display unit for each of the lines such that the converted video signal is input to each of the display elements based on the determined proportion.

According to the implementation, the proportion of the period during which the respective display elements are caused not to emit light that is based on the video signal to one frame period is optimized line by line, but not frame by frame which is the conventional method. Thus, in particular, in the case where an image having large luminance differences within the same frame is displayed, the proportion relative to the rows having low luminance levels can be increased. With this, it is possible to increase the range of gray levels in a portion with dark gray levels. Accordingly, by finely setting the proportion line by line, it is possible to resolve the moving image blur, and also to improve resolution of a portion with dark gray levels.

Further, it may be that the period during which each of the display elements is caused not to emit light that is based on the video signal is a period which is independent of the video signal and during which an electric signal corresponding to a signal having a lowest gray level is input to each of the display elements.

According to the implementation, the period during which the respective elements are caused not to emit light that is based on the video signal is a period during which an electric signal corresponding to the video signal having the lowest gray level is input to the respective display elements. Thus, the proportion is defined as the black insertion rate.

Further, it may be that the display device further includes a signal determination unit which determines, for each of the lines, a maximum luminance signal from the pre-conversion video signal in each of the lines, in which the proportion determination unit determines, for each of the lines, the proportion based on the maximum luminance signal.

According to the implementation, the black insertion rate per line is determined by determining the maximum luminance signal in each line. For example, the range of gray levels in each line can be maximized by scaling the maximum luminance signal in each line as the maximum input gray level.

Further, it may be that the proportion determination unit increases the proportion determined by the proportion determination unit as a luminance level of the maximum luminance signal determined by the signal determination unit becomes lower.

According to the implementation, the range of gray levels in a portion with dark gray levels can be increased by increasing the black insertion rate relative to the lines having low luminance levels.

Further, it may be that the signal conversion unit converts the video signal in each of the lines to a video signal having a luminance level higher than a luminance level of the video signal in the each of the lines, as the luminance level of the maximum luminance signal determined by the signal determination unit in each of the lines becomes lower.

According to the implementation, it is possible to achieve the luminance to be originally displayed in a single frame period by increasing the range of gray levels in a portion with dark gray levels according to the increase in black insertion rate for the lines having low luminance levels.

Further, it may be that the signal conversion unit converts the maximum luminance signal determined by the signal determination unit for each of the lines to a signal having a highest gray level, and to convert an other video signal in the each of the lines at a same conversion rate as a conversion rate used for converting the maximum luminance signal to the signal having the highest gray level.

According to the implementation, the range of gray levels in a portion with dark gray levels can be maximized because the maximum luminance signal is converted to a video signal having the maximum gray level according to the black insertion rate in the line having a low luminance level. Further, other video signals included in the line are converted at the same conversion rate as the conversion rate used for converting from the maximum luminance signal to the video signal having the maximum gray level. With this, the luminance of one frame that is recognized by the user is the same between the case where the video signal before the conversion is output to the display unit without black insertion and the case where the converted video signal is output to the display unit at the predetermined black insertion rate.

Further, it may be that each of the display devices is an organic electroluminescent element.

Further, it may be that the display device further includes a plurality of gate lines each provided in a corresponding one of the lines, and a plurality of data lines arranged in a direction orthogonal to the gate lines, wherein each of the display elements is arranged at a respective one of crossing points of the gate lines and the data lines, the signal output unit is configured to output the video signal converted by the signal conversion unit, to each of the data lines, and the scanning unit is configured to output the scanning signal to each of the gate lines.

According to the implementation, the converted video signal output from the signal output unit is supplied to the display elements via the data lines. Further, the scanning signal for controlling the timing at which the converted video signal is supplied to the display elements is supplied to the display unit via the gate lines.

Further, it may be that the signal output unit is configured to alternately output the video signal converted by the signal conversion unit and a non-video signal to the display unit via each of the data lines, and the scanning unit includes: a first scanning unit configured to output a first scanning signal in a line-sequential order in synchronization with the output of the video signal converted by the signal conversion unit to the display unit; and a second scanning unit configured to output a second scanning signal in synchronization with the output of the non-video signal such that a proportion of a period to a single frame period is the proportion determined by the proportion determination unit, the period being a period during which the non-video signal is input to each of the display elements.

According to the implementation, the converted video signal output from the signal output unit is supplied to the display elements in a line-sequential order. On the other hand, the non-video signal output from the signal output unit is supplied to the display elements according to the proportion of the black insertion period to a single frame period. The black insertion period is a period during which the respective display elements are caused not to emit light that is based on the video signal. With this, the black insertion period per line can be set using the non-video signal supplied from the data line at a predetermined interval; and thus, the pixel circuit can be simplified without adding a control line for determining the black insertion period.

Further, it may be that the display unit includes a plurality of light-emitting pixels arranged in a matrix, each of the light-emitting pixels includes: the display element; and a driving element electrically connected to the display element, the driving element determining emission of light of the display element, and the non-video signal output by the signal output unit is a signal for electrically disconnecting the driving element and the display element.

According to the implementation, the display elements arranged in a matrix are electrically connected to a corresponding one of driving elements. With this, it is possible to control the light-emitting period not only by the signal from the signal output unit or the scanning unit that are provided outside the display unit, but also by controlling the driving element.

Further, it may be that the display unit includes a plurality of light-emitting pixels arranged in a matrix, each of the light-emitting pixels includes: the display element; a driving element electrically connected to the display element, the driving element determining emission of light of the display element; a capacitor; and a control line electrically connected to the scanning unit, the control line controlling an electric potential of a first electrode of the capacitor, the driving element is a thin-film transistor having a gate electrode electrically connected to a second electrode of the capacitor, the signal output unit is configured to output the video signal converted by the signal conversion unit, to the display unit via each of the data lines, and the scanning unit includes: a first scanning unit configured to output a first scanning signal in a line-sequential order in synchronization with the output of the video signal converted by the signal conversion unit to the display unit; and a second scanning unit configured to output a second scanning signal for changing an electric potential of the control line such that a proportion of a period to a single frame period is the proportion determined by the proportion determination unit, the period being a period during which the driving element is turned off via the control line.

According to the implementation, the converted video signal output from the signal output unit is supplied to the display elements in a line-sequential order by the first scanning signal output from the scanning unit. On the other hand, the gate voltage of the thin-film transistor provided in each light-emitting pixel is changed by the second scanning signal output from the scanning unit to turn off the thin-film transistor. As a result, the video signal output from the signal output unit is converted to a non-video signal which causes the display elements not to emit light. The second scanning signal provided to the control line is output to the display unit according to the proportion of the non-video signal period to a single frame period. With this, the black insertion period can be set on a line-by-line basis according to the change in the voltage of the control line connected to the driving element. Accordingly, it is not necessary to alternately output the video signal and the non-video signal to the data line, and thus, the frequency of the switching of the signal output from the signal output unit and the scanning unit does not increase. As a result, the signal output load decreases. Further, the timing at which the non-video signal is output to the data line is not the only way the setting of the non-video signal period is made. This allows more precise setting of the black insertion period.

Further, according to an implementation, a method for driving a display device including a display unit including a plurality of display elements arranged in a matrix, the display elements emitting light based on a video signal that is input, the method includes: determining, for each of lines of the matrix, a proportion of a period to a single frame period, the period being a period during which each of the display elements is caused not to emit light that is based on the video signal; converting, for each of the lines, an amplitude of the video signal according to the proportion determined in the determining; outputting the video signal converted in the converting, to the display unit; and outputting a scanning signal to the display unit for each of the lines such that the video signal converted in the converting is input to each of the display elements based on the determined proportion.

Further, it may be that in the outputting of the video signal, the video signal converted in the converting and a non-video signal are alternately output to the display unit, in the outputting of a scanning signal, a first scanning signal is output to the display unit in a line-sequential order in synchronization with the output of the converted video signal, and a second scanning signal is output to the display unit in synchronization with the output of the non-video signal such that a proportion of a period to a single frame period is the proportion determined in the determining, the period being a period during which the non-video signal is input to each of the display elements.

Further, it may be that the display unit includes a plurality of light-emitting pixels arranged in a matrix, each of the light-emitting pixels includes: the display element; a capacitor; a driving transistor having a gate electrode electrically connected to a second electrode of the capacitor, the driving transistor determining emission of light of the display element; and a control line for controlling an electric potential of a first electrode of the capacitor, wherein, in the outputting of the video signal, the video signal converted in the converting is output to the display unit, and in the outputting of a scanning signal, a first scanning signal is output to the display unit in a line-sequential order in synchronization with the output of the converted video signal; and a second scanning signal for changing an electric potential of the control line is output such that a proportion of a period to a single frame period is the proportion determined in the determining, the period being a period during which the driving element is turned off via the control line.

Hereinafter, preferred embodiments of the present invention are described based on the drawings. Hereinafter, like numerals are used to indicate like elements or corresponding elements throughout the drawings, and the duplicated description are omitted.

Embodiment 1

FIG. 1 is a functional block diagram of a display device according to Embodiment 1 of the present invention. A display device 1 shown in FIG. 1 includes a display unit 11, a signal output unit 12, a scanning unit 13, a timing controller 14, a signal conversion unit 15, and a proportion determination unit 16.

Hereinafter, references are made to functions and structures of the respective units.

The display unit 11 includes a plurality of light-emitting pixels arranged in a matrix. Each light-emitting pixel includes a display element. Here, the display element is an element which emits light by an electric signal corresponding to a video signal externally input. Examples of the display element include an organic electroluminescent (hereinafter, referred to as EL) element or a liquid crystal element.

The proportion determination unit 16 has a function to determine the proportion of a non-video signal period, during which the display element is caused not to emit light that is based on the video signal, to a single frame period. The proportion determination unit 16 determines the proportion for each row that is each line included in the display unit 11. Here, the non-video signal period is a period during which a non-video signal for causing the display element not to emit light that is based on the video signal is input to the display element. For example, the non-video signal period is a period during which a black display is performed in one pixel row. To be more specific, the proportion determination unit 16 refers to a video signal input to the display device 1 to determine the black insertion rate per one pixel row. Hereinafter, the proportion of the non-video signal period to a single frame period is referred to as the black insertion rate.

Although not shown in FIG. 1, it is preferable that the display device 1 includes, at the earlier stage of the proportion determination unit 16 or inside the proportion determination unit 16, a signal determination unit which determines, for each line, a maximum luminance signal among input video signals.

The signal conversion unit 15 has a function to convert the amplitude of the video signal according to the black insertion rate determined by the proportion determination unit 16, and outputs the converted video signal to the signal output unit 12. Specific conversion method will be described with reference to FIG. 3.

The timing controller 14 has a function to control the signal output unit 12 and the scanning unit 13. More specifically, the timing controller 14 informs the signal output unit 12 of the timing at which the converted video signal is output to the display unit 11. The timing controller 14 also informs the scanning unit 13 of the timing at which the converted video signal output from the signal output unit 12 to the display unit 11 is input to the display elements included in the display unit 11. Further, the timing controller 14 informs the scanning unit 13 of the timing at which the non-video signal is input to the display elements included in the display unit 11, according to the black insertion rate determined by the proportion determination unit 16.

The signal output unit 12 has a function to output, to the display unit 11, the video signal converted by the signal conversion unit 15 and the non-video signal which does not cause emission of light that is based on the video signal.

The scanning unit 13 has a function to output a scanning signal to the display unit 11 for each line such that the converted video signal and the non-video signal are input to the respective display elements at the black insertion rate determined by the proportion determination unit 16.

The control function of the timing controller 14 may be included in the signal output unit 12 and the scanning unit 13. In this case, the timing controller 14 may not be included. Instead, it may be that the signal output unit 12 and the scanning unit 13 share the respective functions of the timing controller 14 or it may be that the signal output unit 12 or the scan unit 13 include all the functions of the timing controller 14.

According to Embodiment 1, the black insertion rate relative to a single frame period is optimized per pixel row, but not per frame which is conventionally performed. Thus, it is possible to increase the black insertion rate for the pixel rows having low luminance levels particularly in the case where an image having large luminance differences within one frame is displayed. With this, it is possible to increase the range of gray levels in a portion with dark gray levels. Accordingly, by finely setting the black insertion rate per line, it is possible to resolve the moving image blur, and also to increase the range of gray levels in a portion with dark gray levels.

Figure 2:
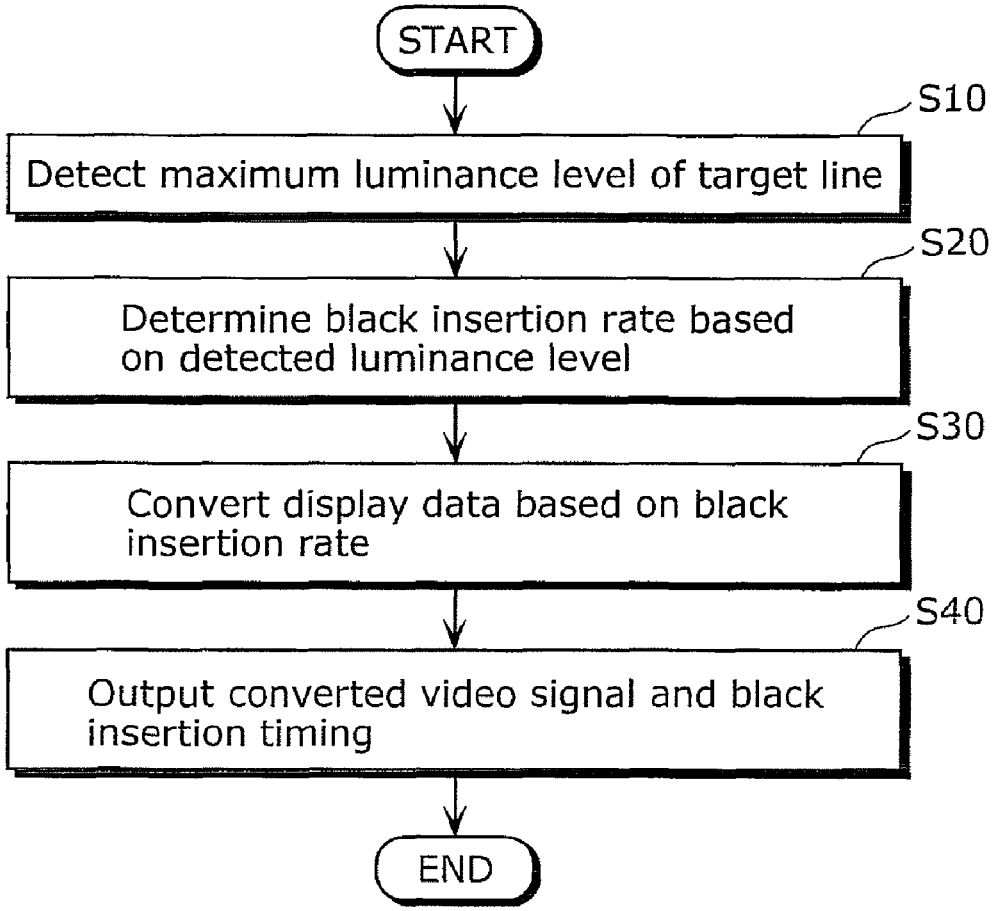
FIG. 2 is a flowchart of operations of the display device according to Embodiments of the present invention.
Figure 3:
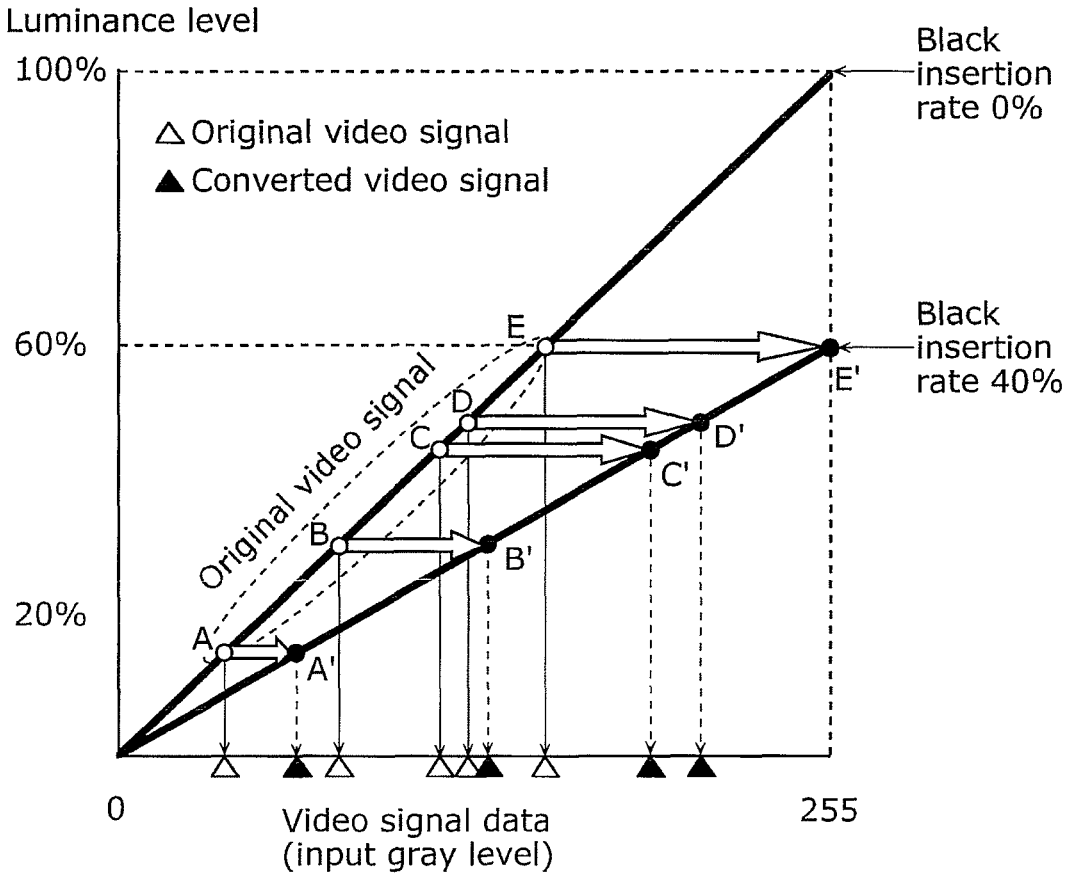
FIG. 3 is a graph showing determination of black insertion rate of the display device according to Embodiments of the present invention.

Next, references are made to a process from the determination of the black insertion rate to the conversion of the video signal with reference to FIGS. 2 and 3.

FIG. 2 is a flowchart of the operations of the display device according to Embodiment 1 of the present invention.

First, the signal determination unit detects, for each line, the maximum luminance level relative to an input video signal (S10).

FIG. 3 is a graph showing the process of determination of the black insertion rate of the display device according to Embodiment 1 of the present invention. The horizontal axis represents video signal data. The vertical axis represents luminance level of one frame of each video signal data. The video signal data represented by the horizontal axis is, for example, a digital value that is an input gray level ranging from 0 to 255. In FIG. 3, it is assumed that original video signal data in a predetermined pixel row is data having input gray levels such as A to E. In Step S10, the signal determination unit detects a maximum luminance signal in the predetermined pixel row as E.

Next, the proportion determination unit 16 determines the black insertion rate for each line (S20). In the example shown in FIG. 3, the luminance of the maximum luminance signal E to be displayed in one frame is 60%. Thus, the proportion determination unit 16 determines the black insertion rate in the predetermined pixel row to be 40%. The determination is made based on the equality of the luminance recognized by a user when the luminance of 60% is displayed in an entire single frame period, and the luminance recognized by the user when the luminance of 100% is displayed in 60% of a single frame period and the luminance of 0% (black gray level) is displayed in 40% of the one frame period.

Next, the signal conversion unit 15 converts the video signal according to the black insertion rate determined in Step S20 (S30), and outputs the resultant to the signal output unit 12. In the example shown in FIG. 3, the maximum luminance signal E in the predetermined pixel row is converted to a signal E' having the maximum input gray level (255). More specifically, the maximum luminance signal E is displayed with the luminance of 100% during the period in which the video signal in the predetermined pixel row is displayed. In the same manner, the video signal data A to D in the same line are respectively converted to the video signal data A' to D' at the same conversion rate as that of the maximum luminance signal E.

Lastly, the signal conversion unit 15 outputs the video signal converted in Step S30 (A' to E' in FIG. 3) and the non-video signal to the display unit 11 (S40).

Further, the scanning unit 13 outputs the scanning signal to the display unit 11 for each pixel row such that the video signals converted in Step S30 (A' to E' in FIG. 3) and the non-video signal are input to the respective display elements at the black insertion rate (S40).

According to the process from the determination of the black insertion rate to the conversion of the video signal, it is preferable that as the luminance level of the maximum luminance signal that is determined by the signal determination unit in a predetermined line is lower, the proportion determination unit 16 increases the black insertion rate in the predetermined line. The range of gray levels in a portion with dark gray levels can be increased by increasing the black insertion rate for the lines having low luminance levels.

Further, it is preferable that as the luminance level of the maximum luminance signal in a predetermined single line is lower, the signal conversion unit 15 increases the conversion rate (amplification rate) of the video signal in the predetermined single line. With this, it is possible to achieve the luminance level to be originally displayed in a single frame period by increasing the range of gray levels in apportion with dark gray levels according to the increase in black insertion rate for the lines having low luminance levels.

Next, references are made to the configuration and operations of each light-emitting pixel which achieves the display operation based on the determined black insertion rate and the converted video signal in the display device 1.

Figure 4:
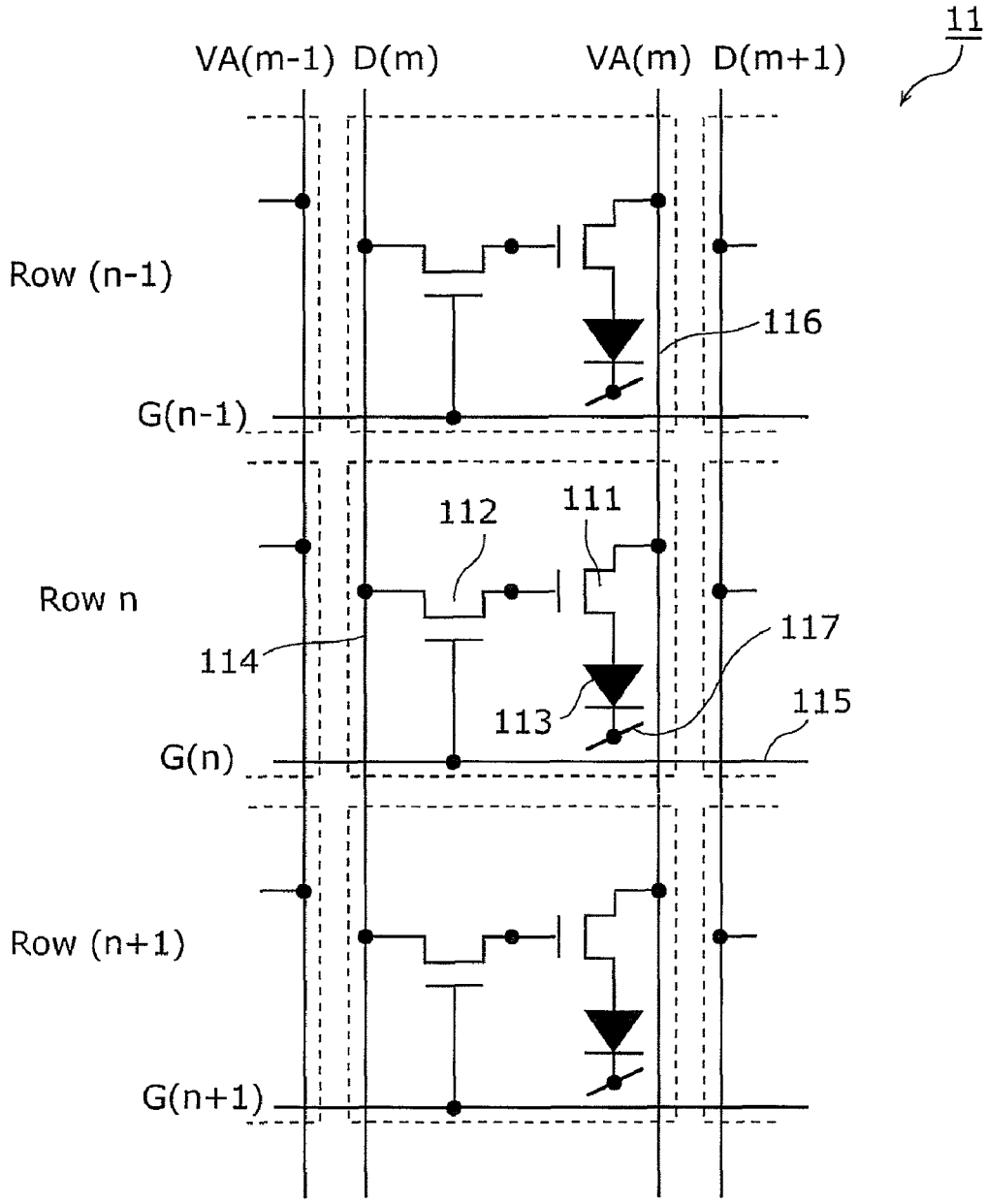
FIG. 4 is a circuit configuration diagram of light-emitting pixels included in a display unit according to Embodiment 1 of the present invention.

FIG. 4 is a fundamental circuit configuration diagram of light-emitting pixels included in the display unit according to Embodiment 1 of the present invention. The display unit 11 shown in FIG. 4 includes light-emitting pixels arranged in a matrix. The respective light-emitting pixels include a driving transistor 111, a selecting transistor 112, an organic EL element 113, a data line 114, a gate line 115, a positive power supply line 116, and a negative power supply line 117. The driving transistor 111 has a drain electrode connected to the positive power supply line 116 and a source electrode connected to an anode of the organic EL element 113. The selecting transistor 112 has a drain electrode connected to the data line 114, a gate electrode connected to the gate line 115, and a source electrode connected to the gate electrode of the driving transistor 111.

The gate line 115 in each pixel row is connected to the scanning unit 13 shown in FIG. 1. The data line 114 in each pixel column is connected to the signal output unit 12 shown in FIG. 1.

In the configuration, a scanning signal is input from the scanning unit 13 to the gate line 115, turning on the selecting transistor 112. The video signal voltage supplied from the signal output unit 12 via the data line 114 successively varies the conductance of the driving transistor 111. Then, the driving current corresponding to the gray level of light emission of the video signal voltage is supplied to the anode of the organic EL element 113 and passed to the cathode. Accordingly, the organic EL elements 113 emit light and are displayed as an image.

The selecting transistor 112 and the driving transistor 111 are fundamental circuit elements necessary for passing the driving current corresponding to the voltage value of the video signal to the organic EL element 113; however, the pixel circuit according to Embodiment 1 is not limited to such configuration. Further, in the case where a capacitor or the like for holding a signal voltage supplied from the data line 114 is added to the fundamental circuit elements, the capacitor is included in the pixel circuit according to Embodiment 1 of the present invention.

Figure 5:
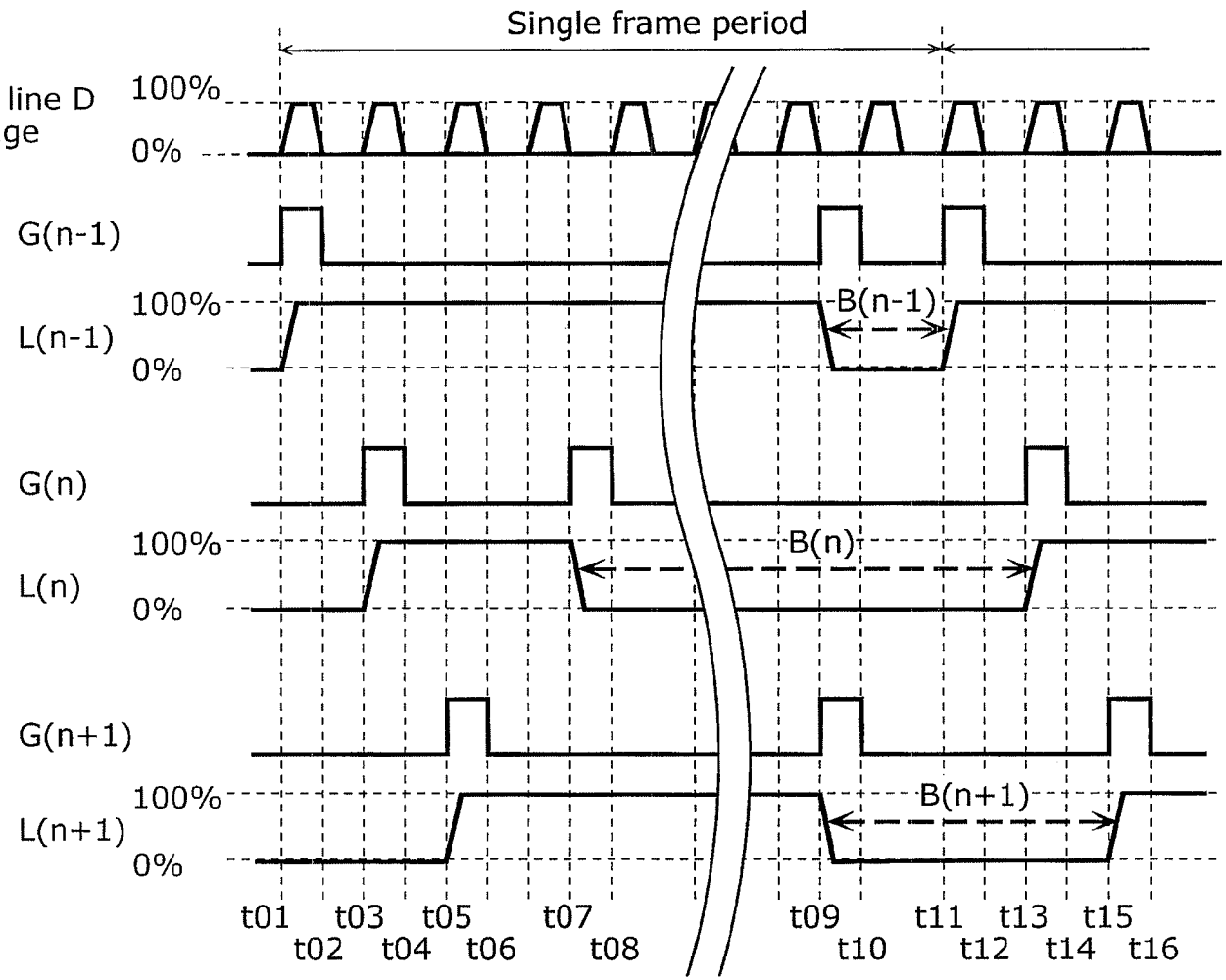
FIG. 5 is a timing diagram of the operations of the display device according to Embodiment 1 of the present invention.

FIG. 5 is a timing diagram of the operations of the display device according to Embodiment 1 of the present invention. In FIG. 5, the horizontal axis represents time. In the order from top to bottom, the following waveforms are shown: the voltage level of the data line 114, the voltage level of gate line G(n−1) in row (n−1), the luminance level L(n−1) of an organic EL element in the row (n−1), the voltage level of gate line G(n) in row n, the luminance level L(n) of an organic EL element in the row n, the voltage level of gate line G(n+1) in row (n+1), and the luminance level L(n+1) of an organic EL element in the row (n+1).

Here, the signal output unit 12 outputs, to the data line 114, video signal data in all rows in a row-sequential order in a single frame period. Further, in the present embodiment, the signal output unit 12 alternately outputs, to the data line 114, the converted video signal and the black insertion signal (the signal corresponding to 0% in FIG. 5) on a row-by-row basis.

At time t01, the scanning unit 13 changes the voltage level of the gate line G(n−1) from low to high to turn on the selecting transistor 112 in the row (n−1). As a result, the driving transistor 111 in the row (n−1) turns on, allowing the driving current corresponding to the voltage level of the converted video signal applied to the gate electrode to flow through the organic EL element 113 in the row (n−1). At this time, the organic EL element 113 in the row (n−1) emits light with the converted luminance as maximum luminance of 100%. The converted luminance is the converted luminance of the maximum luminance signal determined by the proportion determination unit 16 or the signal determination unit.

Next, at time t02, the scanning unit 13 changes the voltage level of the gate line G(n−1) from high to low to turn off the selecting transistor 112 in the row (n−1). At this time, the gate electrode of the driving transistor 111 in the row (n−1) holds the level of the voltage applied at time t01. The voltage holding function is achieved by adding, for example, the capacitor connected between the gate and source of the driving transistor 111, to the fundamental pixel circuit shown in FIG. 4.

The operations at the times t01 to t02 cause a predetermined light emission in the entire row (n−1).

Next, at times t03 to t04, the scanning unit 13 performs, on the gate line G(n), the same operations as those performed at the times t01 to t02. This also causes a predetermined light emission in the row n.

Next, the scanning unit 13 performs the same operations as those performed at times t01 to t02, on the gate line G(n+1) at times t05 to t06. This causes a predetermined light emission in the row (n+1).

More specifically, at times t01 to t06, the scanning unit 13 outputs a first scanning signal to the display unit 11 in a line-sequential order in synchronization with the converted video signal output by the signal output unit 12.

Next, at time t07, the scanning unit 13 changes the voltage level of the gate line G(n) from low to high to turn on the selecting transistor 112 in the row n. At time t07, the voltage level of the data line 114 is the black insertion signal level; and thus, the driving transistor 111 in the row n turns off, causing the organic EL element 113 in the row n to stop emitting light. Subsequently, at time t13, a time period until the scanning unit 13 changes the voltage level at the gate line G(n) from low to high is a black insertion period B(n) where each light-emitting pixel in the row n does not emit light and a black display is performed.

Next, at time t09, the scanning unit 13 changes the voltage level of the gate line G(n−1) and the gate line G(n+1) from low to high to turn on the selecting transistors 112 in the row (n−1) and the row (n+1). At time t09, the voltage level of the data line 114 is the non-video signal level; and thus, the driving transistors 111 in the row (n−1) and the row (n+1) turn off, causing the organic EL elements 113 in the row (n−1) and the row (n+1) to stop emitting light. Subsequently, at time t11, the pixel row in the row (n−1) is in a black insertion period B(n−1) till the scanning unit 13 changes the voltage level of the gate line G(n−1) from low to high. In the black insertion period B(n−1), each light-emitting pixel in the row (n−1) does not emit light, and a black display is performed. Further, at time t15, the pixel row in the row (n+1) is in a black insertion period B(n+1) till the scanning unit 13 changes the voltage level of the gate line G(n+1) from low to high. In the black insertion period B(n+1), each light-emitting pixel in the row (n+1) does not emit light, and a black display is performed.

In the operation timing chart shown in FIG. 5, it is assumed that the order of the luminance level of the maximum luminance signal in each row from highest to lowest is the row (n−1), the row (n+1) and the row n. Therefore, the order of the conversion rate (amplification rate) of the video signal input to the display device 1 from highest to lowest is the row n, the row (n+1) and the row (n−1). The black insertion period is in relation of B(n)>B(n+1)>B(n−1).

To be more specific, at times t07 to t15, the scanning unit 13 outputs a second scanning signal to the display unit 11 in synchronization with the output of the black insertion signal by the signal output unit 12 such that the proportion of the black insertion period to a single frame period is the black insertion rate determined by the proportion determination unit 16.

With such operations, the scanning unit 13 has a function to input the converted video signal to the organic EL elements 13 via the gate line 115 in a row-sequential order, and also a function to input, at a given time to the organic EL elements 113, the black insertion signal according to the black insertion rate determined for each pixel row.

According to the present embodiment, the converted video signal output from the signal output unit 12 is supplied to the organic EL elements 113 in a line-sequential order. On the other hand, the non-video signal output from the signal output unit 12 is supplied to the organic EL elements 113 according to the black insertion rate. This allows the black insertion period for each line to be set using the black insertion signal supplied from the data line 114 at a predetermined time interval. As a result, it is possible to simplify the pixel circuit without adding a control line for determining the black insertion period.

Embodiment 2

The present embodiment is different from Embodiment 1 in the method for supplying a non-video signal which does not cause emission of light that is based on a video signal input to a light-emitting element.

Figure 6:
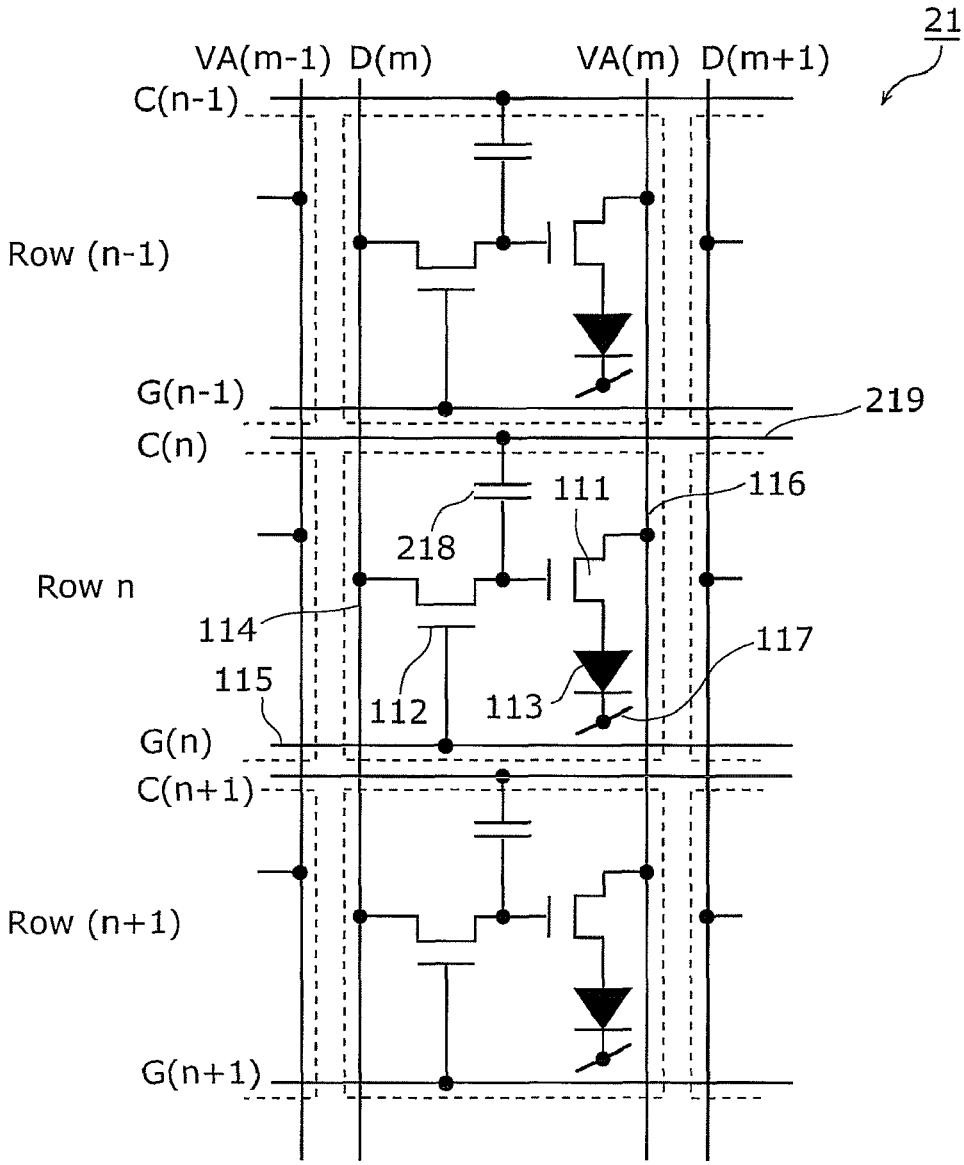
FIG. 6 is a circuit configuration diagram of light-emitting pixels included in a display unit according to Embodiment 2 of the present invention.

FIG. 6 shows a fundamental circuit configuration diagram of light-emitting pixels included in the display unit according to Embodiment 2 of the present invention. The display unit 21 shown in FIG. 6 includes light-emitting pixels arranged in a matrix. The respective light-emitting pixels include a driving transistor 111, a selecting transistor 112, an organic EL element 113, a data line 114, a gate line 115, a positive power supply line 116, a negative power supply line 117, a capacitor 218, and a control line 219.

The display unit 21 shown in FIG. 6 is different from the display unit 11 shown in FIG. 4 in that a capacitor having a function to apply a bias voltage and a control line 219 are added. Hereinafter, differences are described while descriptions of the points identical to Embodiment 1 are omitted.

The capacitor 218 has a first electrode connected to the control line 219, and a second electrode connected to the gate electrode of the driving transistor 111. The capacitor 218 has a function to apply a bias voltage to the gate electrode of the driving transistor 111 according to the voltage level of the control line 219. Further, the capacitor 218 has a function to hold a video signal voltage supplied from the data line 114.

The control line 219 is connected to the scanning unit 13, and has a function to apply the potential output from the scanning unit 13 to the first electrode of the capacitor 218.

In the configuration, a first scanning signal is input from the scanning unit 13 to the gate line 115 to turn on the selecting transistor 112. The video signal voltage supplied from the signal output unit 12 via the data line 114 successively varies the conductance of the driving transistor 111. Then, the driving current corresponding to the gray level of light emission of the video signal voltage is supplied to the anode of the organic EL element 113 and passed to the cathode. In such a manner, the organic EL elements 113 emit light and are displayed as an image.

Further, by the second scanning signal being input to the control line 219 from the scanning unit 13, it is possible to set the electric potential of the gate electrode of the driving transistor 111 such that the driving transistor 111 turns off via the capacitor 218. With this, it is possible to supply the organic EL elements 113 with a video signal supplied via the data line 114 from the signal output unit 12 as a non-video signal which does not cause emission of light that is based on the video signal.

In the present embodiment, the signal output unit 12 outputs, per pixel row, the video signal converted by the signal conversion unit 15, but does not output a black insertion signal that is a non-video signal to the display unit 21 via the data line.

The selecting transistor 112 and the driving transistor 111 are fundamental circuit elements necessary for passing the driving current corresponding to the voltage value of the video signal to the organic EL elements 113; however, the pixel circuit according to the present embodiment is not limited to such configuration. Further, in the case where other elements are added to the fundamental circuit elements, the added elements are included in the pixel circuit according to the present embodiment of the present invention.

Figure 7:
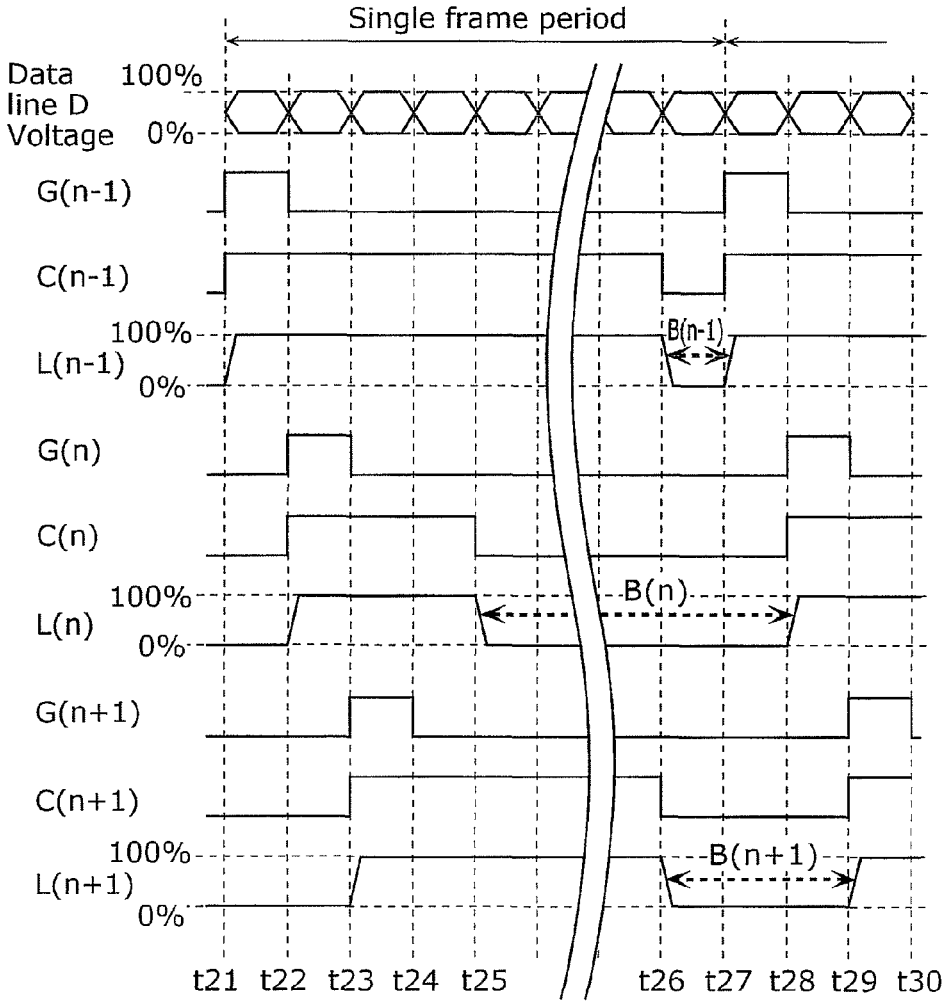
FIG. 7 is a timing diagram of operations of the display device according to Embodiment 2 of the present invention.

FIG. 7 is a timing chart of the operations of the display device according to Embodiment 2 of the present invention. In FIG. 7, the horizontal axis represents time. In the order from top to bottom, the following waveforms are shown: the voltage level of the data line 114, the voltage level of the gate line G(n−1) in the row (n−1), the voltage level of the control line C(n−1) in the row (n−1), the luminance level L(n−1) of an organic EL element in the row (n−1), the voltage level of the gate line G(n) in the row n, the voltage level of the control line C(n) in the row n, the luminance level L(n) of an organic EL element in the row n, the voltage level of the gate line G(n+1) in the row (n+1), the voltage level of the control line C(n+1) in the row (n+1), and the luminance level L(n+1) of an organic EL element in the row (n+1).

Here, the signal output unit 12 outputs video signal data in all rows to the data line 114 in a single frame period in a row-sequential order. Further, in the present embodiment, the signal output unit 12 outputs the converted video signal to the data line 114, but does not output the black insertion signal (signal corresponding to 0% in FIG. 5).

First, at time t21, the scanning unit 13 changes the voltage level of the gate line G(n−1) from low to high to turn on the selecting transistor 112 in the row (n−1). At the same time, the scanning unit 13 changes the voltage level of the control line C(n−1) from low to high to cause the bias voltage applied to the gate electrode of the driving transistor 111 in the row (n−1) to be in a high state. With this, the driving transistor 111 in the row (n−1) turns on, allowing the driving current corresponding to the voltage level of the converted video signal applied to the gate electrode to flow through the organic EL elements 113 in the row (n−1). At this time, the organic EL element 113 in the row (n−1) emits light with the converted luminance as maximum luminance of 100%. The converted luminance is the converted luminance of the maximum luminance signal determined by the signal determination unit.

Next, at time t22, the scanning unit 13 changes the voltage level of the gate line G(n−1) from high to low to turn off the selecting transistor 112 in the row (n−1). Here, the gate electrode of the driving transistor 111 in the row (n−1) holds the level of the voltage applied at time t21.

The operations performed on the row (n−1) at times t21 to t22 cause a predetermined light emission in the entire row (n−1).

Next, the scanning unit 13 performs, on the gate line G(n) and the control line C(n) at times t22 to t23, the same operations as those performed on the row (n−1) at times t21 to t22. This also causes a predetermined light emission in the row n.

Next, the scanning unit 13 performs, on the gate line G(n+1) and the control line C(n+1) at times t23 to t24, the same operations as those performed on the row (n−1) at times t21 to t22. This causes a predetermined light emission in the row (n+1).

More specifically, at times t21 to t24, the scanning unit 13 outputs a first scanning signal to the display unit 11 in a line-sequential order in synchronization with the output of the converted video signal by the signal output unit 12.

Next, at time t25, the scanning unit 13 changes the voltage level of the control line C(n) from high to low to cause the bias voltage applied to the gate electrode of the driving transistor 111 in the row n to be in a low state. With this, the driving transistor 111 in the row n turns off. The converted video signal applied to the gate electrode is converted to a non-video signal which does not cause emission of light that is based on the video signal and input to the organic EL elements 113 in the row n. Here, the organic EL elements 113 in the row n stops emitting light. Subsequently, at time t28, a time period until the scanning unit 13 changes the voltage level of the gate line G(n) and the control line C(n) from low to high is a black insertion period B(n) during which each light-emitting pixel in the row n performs a black display.

Next, at time t26, the scanning unit 13 changes the voltage level of the control line C(n−1) and the control line C(n+1) from high to low to cause the bias voltage applied to the gate electrode of the driving transistor 111 in the row (n−1) and the row (n+1) to be in a low state. With this, the driving transistors 111 in the row (n−1) and the row (n+1) turn off. The converted video signal applied to the gate electrode is converted to a non-video signal which does not cause emission of light that is based on the video signal and is input to the organic EL elements 113 in the row (n−1) and the row (n+1). Here, the organic EL elements 113 in the row (n−1) and the row (n+1) stop emitting light. Subsequently, at time t27, for the pixel row in the row (n−1), a period until the scanning unit 13 changes the voltage level of the gate line G(n−1) and the control line C(n−1) from low to high is the black insertion period B(n−1) during which each light-emitting pixel in the row (n−1) performs a black display.

Further, at time t29, for the pixel row in the row (n+1), a period until the scanning unit 13 changes the voltage level of the gate line G(n+1) and the control line C(n+1) from low to high is the black insertion period B(n+1) during which each light-emitting pixel in the row (n+1) performs a black display.

In the operation timing chart shown in FIG. 7, it is assumed that the order of the luminance level of the maximum luminance signal in each row from highest to lowest is the row (n−1), the row (n+1) and the row n. Therefore, the order of the conversion rate (amplification rate) of the video signal input to the display device 1 from highest to lowest is the row n, the row (n+1) and the row (n−1). The black insertion period is in the relation of B(n)>B(n+1)>B(n−1).

More specifically, the scanning unit 13 at times t25 to t29 outputs the second scanning signal for changing the electric potential of the control line 219 to turn off the driving transistor 111 such that the period during which the organic EL elements do not emit light that is based on the video signal is a period that is based on the black insertion rate determined by the proportion determination unit 16.

With such operations, the scanning unit 13 has a function to input the converted video signal to the organic EL elements 13 via the gate line 115 in a row-sequential order, and also a function to input, to the organic EL elements 113 via the control line 219, the black insertion signal which does not cause emission of light that is based on the video signal according to the black insertion rate determined for each pixel row at a given time.

According to the present embodiment, the converted video signal output from the signal output unit 12 is supplied to the display elements in a line-sequential order by the first scanning signal output from the scanning unit. On the other hand, the video signal output from the signal output unit 12 is converted to a non-video signal which does not cause emission of light that is based on the video signal, by changing the gate voltage of the driving transistor 111 in each light-emitting pixel by the second scanning signal to turn off the driving transistor 111. The second scanning signal to the control line 219 is output to the display unit 11 according to the black insertion rate. With this, the black insertion period per line can be set according to the change in the voltage of the control line 219 connected to the driving transistor 111. Accordingly, it is not necessary to output the video signal and the non-video signal alternately to the data line 114, and the frequency of the switching of the signal output from the signal output unit 12 and the scanning unit 13 does not increase. As a result, the signal output load decreases. Further, the timing at which the non-video signal is output to the data line is not the only way the setting of the non-video signal period is made. This allows more precise setting of the black insertion period.

The display device according to the present invention has been described based on Embodiments 1 and 2; however, the display device according to the present invention is not limited to those embodiments. The present invention includes other embodiments achieved by combining some of the elements in Embodiments 1 and 2, variations obtained by performing various modifications conceivable by a skilled person on Embodiments 1 and 2 without departing from the scope of the present invention, and various types of devices which include the display device according to the present invention.

For example, in Embodiments 1 and 2, the proportion determination unit 16 determines the black insertion rate for each pixel row, but may determine the black insertion rate for each block. Here, the block includes two or more pixel rows. Further, the display unit includes two or more blocks in the pixel region to be displayed in a single frame period. In such a case, too, it is possible to increase the black insertion rate for the blocks with low luminance levels when displaying an image having large luminance differences within a same frame. With this, it is possible to increase the range of the gray levels in a portion with dark gray levels. Therefore, by finely setting the black insertion rate on a block-by-block basis, it is possible to resolve the moving image blur, and also to enhance the resolution of a portion with dark gray levels.

Further, in Embodiments 1 and 2, the proportion determination unit 16 determines the black insertion rate for each pixel row, but may determine the black insertion rate for each pixel column instead of each pixel row. In this case, as a premise, a display method of the display device employs the scanning method performed on a column-by-column basis, but not on a row-by-row basis.

Further, in Embodiments 1 and 2, black data is used as a non-video signal which does not cause light emission that is based on the video signal; however, the non-video signal is not limited to the video signal data having the lowest gray level.

Further, in the aforementioned embodiments, it has been described that the selecting transistor is an n-type transistor which turns on when the voltage level of the gate is high. However, the image display device may include a p-type transistor instead and the scanning line having an inverted polarity. Such an image display device also produces the same advantageous effects as those obtained by the embodiments.

Figure 8:
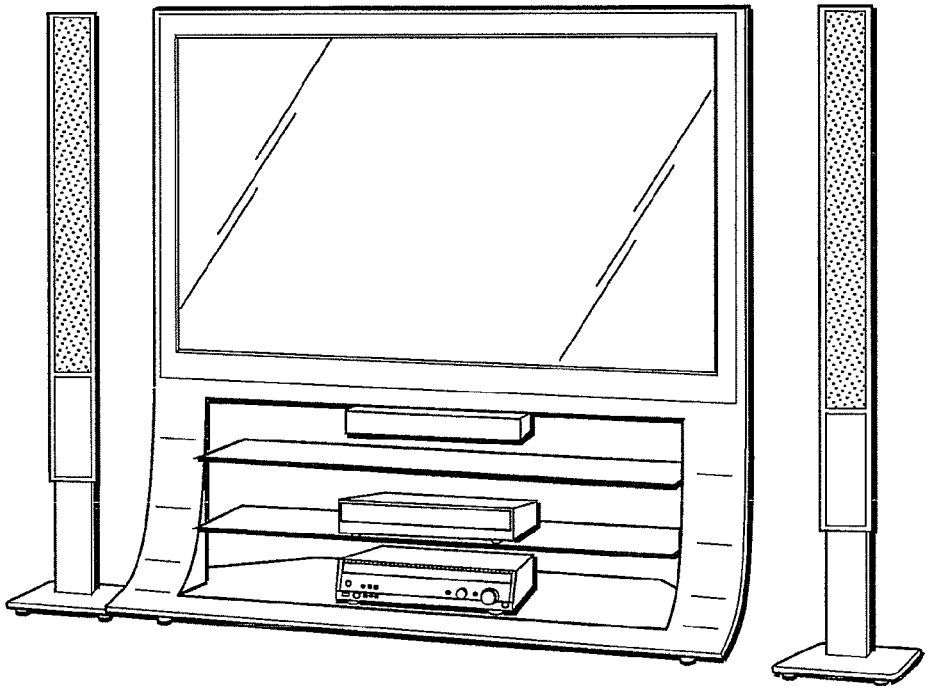
FIG. 8 is an external view of a thin flat TV including the display device according to Embodiments of the present invention.
Figure 9:
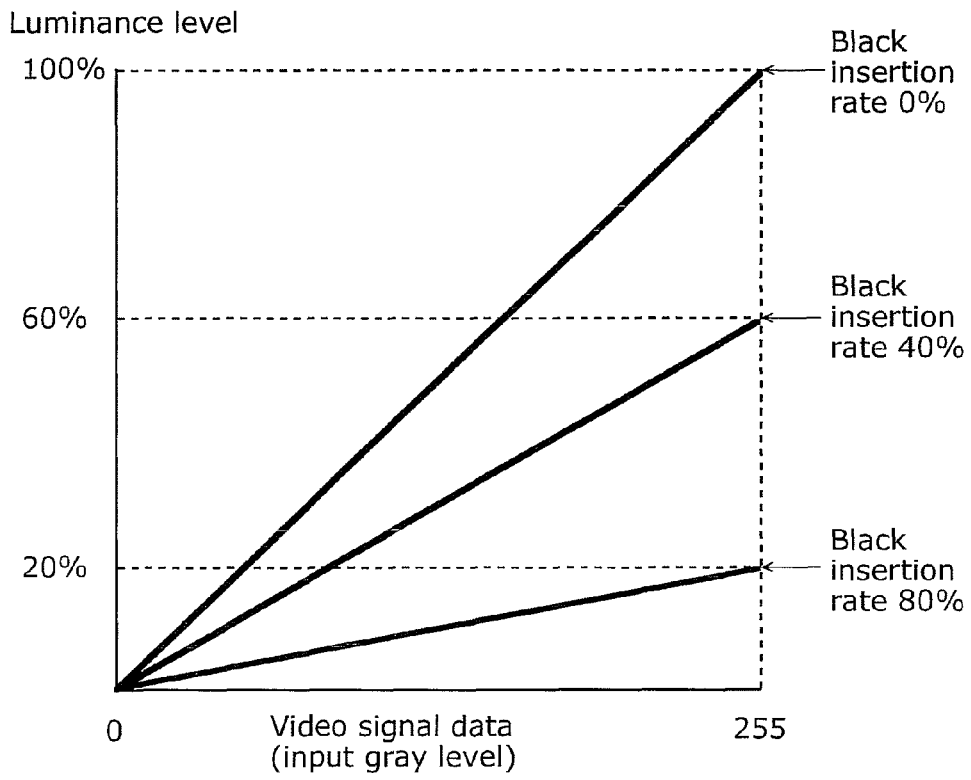
FIG. 9 is a graph showing a black insertion technique.

For instance, the display device according to an implementation of the present invention is included in a thin-flat TV as shown in FIG. 8. By including the display device according to an implementation of the present invention, it is possible to achieve a thin-flat TV which is capable of displaying high-resolution images even in a portion with dark gray levels without having moving image blur.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The present invention is useful to a hold-type display device in which an image is continuously held during a frame period, and in particular to an active-type organic EL flat panel display which is required to display high-quality moving images.

What is claimed is:

1. A display device, comprising:

a display including a plurality of display elements arranged in lines of a matrix, said plurality of display elements each configured to emit light based on a video signal that is received by said display;

a proportion determiner configured to determine, for each of the lines of the matrix, a proportion of a single frame period during which each of said plurality of display elements of a corresponding line of the lines of the matrix is not to emit the light;

a signal converter configured to convert an amplitude of the video signal for each of the lines of the matrix according to the proportion determined for each of the lines of the matrix by said proportion determiner;

a signal output configured to output the video signal converted by said signal converter to said display as a converted video signal; and a scanner configured to output a scanning signal to said display for each of the lines of the matrix for inputting the converted video signal to said plurality of display elements of each of the lines of the matrix based on the proportion determined for each of the lines of the matrix by said proportion determiner.

2. The display device according to claim 1, wherein the proportion of the single frame period of each of the lines of the matrix during which said plurality of display elements of each of the lines of the matrix is not to emit light is independent of the video signal and corresponds to an electric signal for emitting a predetermined gray level being input to said plurality of display elements of each of the lines of the matrix.

3. The display device according to claim 1, further comprising:

a signal determiner configured to determine, for each of the lines of the matrix, a maximum luminance signal from the video signal before the signal converter converts the video signal, wherein said proportion determiner is configured to determine, for each of the lines of the matrix, the proportion based on the maximum luminance signal.

4. The display device according to claim 3, wherein said proportion determiner is configured to increase, for each of the lines of the matrix, the proportion as a luminance level of the maximum luminance signal, determined by said signal determiner, decreases.

5. The display device according to claim 4, wherein said signal converter is configured to increase, for each of the lines of the matrix, a luminance level of the video signal as the luminance level of the maximum luminance signal, determined by said signal determiner, decreases.

6. The display device according to claim 5, wherein said signal converter is configured, for each of the lines of the matrix, to convert the maximum luminance signal, determined by said signal determiner, to a signal having a highest gray level in accordance with a conversion rate, and to convert an other video signal in accordance with the conversion rate.

7. The display device according to claim 1, wherein each of said plurality of display devices comprises an organic electroluminescent element.

8. The display device according to claim 1, further comprising:

a plurality of gate lines, each provided for one of the lines of the matrix; and a plurality of data lines arranged orthogonal to the plurality of gate lines, wherein each of said plurality of display elements is arranged at a crossing point of one of said plurality of gate lines and one of said plurality of data lines, said signal output is configured to output the converted video signal to each of said plurality of data lines, and said scanner is configured to output the scanning signal to each of said plurality of gate lines.

9. The display device according to claim 8, wherein said signal output is configured to alternately output the converted video signal and a non-video signal to said display via each of said plurality of data lines, and said scanner includes:

a first scanner configured to output a first scanning signal to the display for each of the lines of the matrix in a line-sequential order in synchronization with the converted video signal that is output by said signal output to said display; and a second scanner configured to output a second scanning signal to the display for each of the lines of the matrix in synchronization with the non-video signal output by said signal output, such that the non-video signal is input to said plurality of display elements of each of the lines of the matrix in accordance with the proportion of the single frame period of each of the lines of the matrix.

10. The display device according to claim 9, wherein said display includes a plurality of light-emitting pixels arranged in the matrix, each of said plurality of light-emitting pixels includes:

one display element of said plurality of display elements; and a driver electrically connected to said one display element that determines emission of the light by said one display element, and the non-video signal output by said signal output electrically disconnects said driver and said one display element.

11. The display device according to claim 8, wherein said display includes a plurality of light-emitting pixels arranged in a matrix, each of said plurality of light-emitting pixels includes:

one display element of said plurality of display elements;

a capacitor having a first electrode and a second electrode;

a driver electrically connected to said one display element that determines emission of the light by said one display element, said driver being a thin-film transistor having a gate electrode electrically connected to said second electrode of said capacitor; and a control line electrically connected to said scanner that controls an electric potential of said first electrode of said capacitor, said signal output is configured to output the converted video signal to said display via each of said plurality of data lines, and said scanner includes:

a first scanner configured to output a first scanning signal in a line-sequential order in synchronization with the converted video signal that is output by said signal output to said display; and a second scanner configured to output a second scanning signal to each of said plurality of light-emitting pixels for changing an electric potential of said control line to turn OFF said driver via said control line in accordance with the proportion of the single frame period.

12. A method for driving a display device, the display device including a display that includes a plurality of display elements arranged in lines of a matrix, the plurality of display elements each configured to emit light based on a video signal, said method comprising:

determining, for each line of the lines of the matrix, a proportion of a single frame period during which each of the plurality of display elements of a corresponding line of the lines of the matrix is not to emit the light;

converting an amplitude of the video signal for each of the lines of the matrix according to the proportion determined for each of the lines of the matrix;

outputting the video signal converted according to the proportion determined for each of the lines of the matrix to the display as a converted video signal; and outputting a scanning signal to the display for each of the lines of the matrix for inputting the converted video signal to the plurality of display elements of each of the lines of the matrix based on the proportion determined for each of the lines of the matrix.

13. The method for driving the display device according to claim 12, wherein the converted video signal is output to the display alternately with a non-video signal, and the scanning signal includes:

a first scanning signal that is output to the display for each of the lines of the matrix in a line-sequential order in synchronization with the converted video signal that is output to the display; and a second scanning signal that is output to the display for each of the lines of the matrix in synchronization with the non-video signal that is output to the display, such that the non-video signal is input to the plurality of display elements of each of the lines of the matrix in accordance with the proportion of the single frame period of each of the lines of the matrix.

14. The method for driving the display device according to claim 12, wherein the display includes a plurality of light-emitting pixels arranged in the matrix, each of the plurality of light-emitting pixels includes:

one display element of the plurality of display elements;

a capacitor having a first electrode and a second electrode;

a driver having a gate electrode electrically connected to the second electrode of the capacitor, the driver determining emission of the light by the one display element; and a control line for controlling an electric potential of the first electrode of the capacitor, and the scanning signal includes:

a first scanning signal that is output in a line-sequential order in synchronization with the converted video signal that is output to the display; and a second scanning signal that is output to each of the plurality of light-emitting pixels for changing an electric potential of the control line to turn OFF the driver via the control line in accordance with the proportion of the single frame period.

* * * * *